United States Patent [19]

Larson

[11] 4,332,043

[45] Jun. 1, 1982

[54] WATERBED MATTRESS

[76] Inventor: Lynn D. Larson, Rural Route, Walton, Nebr. 68461

[21] Appl. No.: 111,594

[22] Filed: Jan. 14, 1980

[51] Int. Cl.[3] ..... A47C 27/08

[52] U.S. Cl. ..... 5/450; 5/451

[58] Field of Search ..... 5/450, 451, 452, 449, 5/481

[56] References Cited

U.S. PATENT DOCUMENTS

| | | | |
|---|---|---|---|
| 3,574,873 | 4/1971 | Weinstein | 5/450 |
| 3,600,726 | 8/1971 | Williams | 5/450 |
| 3,689,945 | 9/1972 | Laerdal | 5/450 |
| 4,192,031 | 3/1980 | Fogel | 5/451 |
| 4,245,361 | 1/1981 | Evanson | 5/451 |
| 4,247,962 | 2/1981 | Hall | 5/450 |

FOREIGN PATENT DOCUMENTS

| | | | |
|---|---|---|---|
| 1113718 | 4/1956 | France | 5/481 |
| 1119339 | 6/1956 | France | 5/481 |
| 78004777 | 12/1979 | Sweden | 5/450 |
| 428124 | 7/1967 | Switzerland | 5/450 |
| 305911 | 2/1929 | United Kingdom | 5/449 |

*Primary Examiner*—Alexander Grosz

*Attorney, Agent, or Firm*—William D. West

[57] ABSTRACT

A waterbed mattress with one or more open-celled foam members used for dampening wave action in the water is disclosed. The foam members are supported by the buoyant force of the water and require no attachment to the surface of the waterbed mattress bladder. A vacuum means for evacuating air from the bladder and the foam member after the bladder has been drained of water is also disclosed.

6 Claims, 9 Drawing Figures

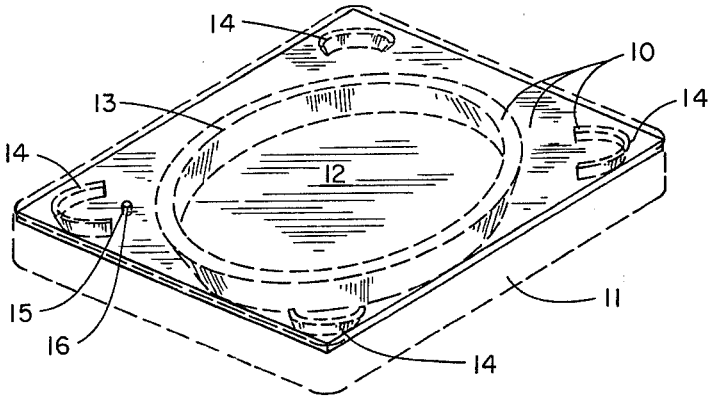
fig. 1
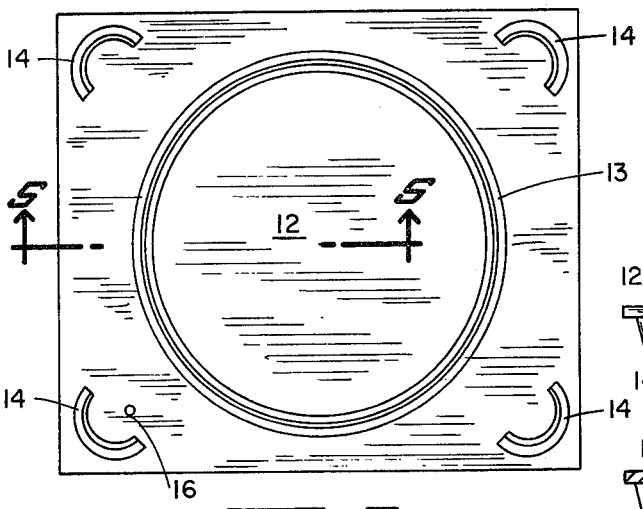
fig. 2
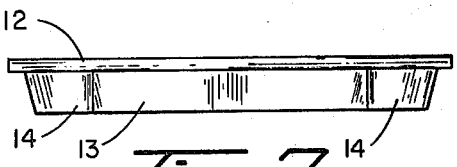
fig. 3
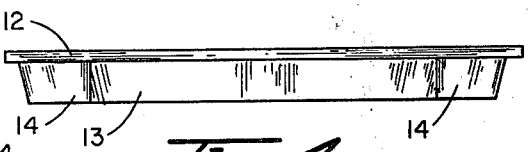
fig. 4
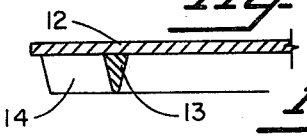
fig. 5
fig. 6
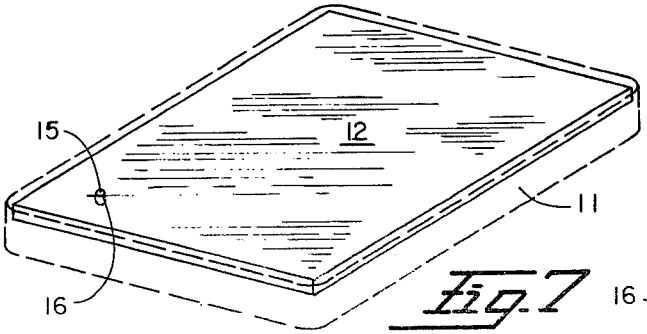
fig. 7
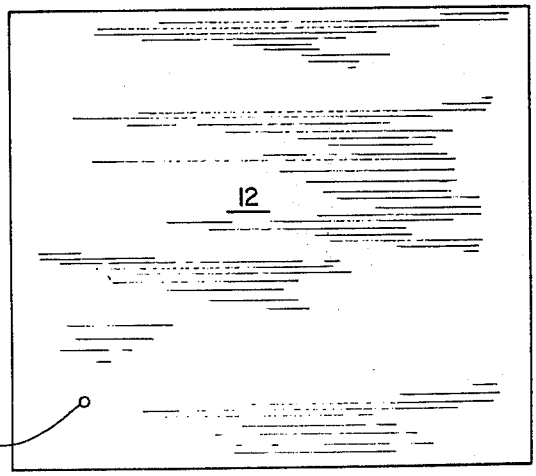

WATERBED MATTRESS

BACKGROUND OF THE INVENTION

Waterbeds have come into widespread use during the past decade. A typical waterbed consists of a water filled bladder supported by a rigid frame. Although early users were primarily younger people attracted by the novelty and low cost of waterbeds, a wider range of consumers have been attracted to waterbeds in recent years for a number of reasons. Perhaps the most important reason is the fact that waterbed mattresses provide uniform support to the sleeper, eliminating "pressure points" on which most of the weight of the body rests when reclining on conventional nonfluid sleeping surfaces. However, there remain a number of drawbacks to be overcome before waterbeds will be readily accepted in the conventional bedding market.

A universal problem in waterbeds to date has been the annoying wave motion set up in the water whenever a person changes position on the waterbed mattress. Generally, a series of transverse waves are set up which are reflected by the lateral walls of the waterbed. Because of this reflecting action, the waves usually continue for several seconds before dampening out. In order to eliminate this problem, it is desirable to make this dampening period as short as possible without impairing other positive features of the waterbed.

Prior inventors have sought to increase the dampening action in waterbeds by a number of different internal baffle arrangements.

Carson, et. al., U.S. Pat. No. 3,736,604, disclose a waterbed mattress with flexible internal baffles welded to the top inside surface of the mattress which also provides that weights may be added to the lower edge of the baffles to increase the dampening action.

Labianco, U.S. Pat. No. 3,840,921 discloses a waterbed mattress with two flexible baffles attached to the upper and lower inner surface of the mattress.

Fogel, U.S. Pat. No. 4,145,780 disclose a waterbed mattress with baffles formed by heat welding flexible plastic sheets to the bottom inside surface of the mattress and attaching the upper edge of each sheet to a flotation rod.

It must be noted that in each of the baffle systems disclosed in the prior art, it was necessary in some way to attach each baffle to at least one inner surface of the waterbed mattress. The costs associated with attaching the baffles to the mattress are likely to be substantial because of the additional number of production steps required. Another problem with baffle systems can be appreciated from the fact that the Carson arrangement provided for weights to be added to the baffles to increase the dampening effect. The problem arises from the fact that if the baffles are too flexible or of insufficient mass, they will be ineffective as a dampening means. However, if the baffles are sufficiently massive and stiff to provide good dampening, they may interfere with the performance of the waterbed mattress. Stiff or massive baffles introduce uncomfortable ridges near the sleeping surface and also make it difficult to collapse the waterbed mattress for storage or shipment.

In summary, means for dampening wave action in waterbeds are disclosed in the art and in prior patents. However, all of these dampening means greatly increase fabrication costs and involve trade offs with other desirable features of the waterbed mattress.

SUMMARY OF THE INVENTION

The waterbed mattress of the present invention is a flexible bladder containing at least one open-celled foam member which is used to dampen wave action in the water. The present invention overcomes a number of problems experienced with other dampening arrangements and also provides a method for compressing the volume of the waterbed mattress for storage.

Accordingly, a primary object of the invention is to provide a waterbed mattress with a means for dampening wave action in the water.

A further object of the invention is to provide a waterbed mattress with a dampening means which is relatively inexpensive.

A further object of the invention is to provide a waterbed mattress with an open-celled foam member used as a dampening means.

A further object of the invention is to provide a waterbed mattress wherein an open-celled foam member is used in combination with other flexible material to provide a dampening means.

A further object of the invention is to provide a waterbed mattress with an open-celled foam member used to absorb air bubbles in the water.

A further object of the invention is to provide a waterbed mattress with an open-celled foam member used as a padding against shocks.

A further object of the invention is to provide a waterbed mattress which may be evacuated of air and compressed into a small volume using a vacuum means.

A further object of the invention is to provide a waterbed mattress which may be fabricated in a variety of sizes and shapes.

A further object of the invention is to provide a waterbed mattress which may be used with a waterbed liner.

A further object of the invention is to provide a waterbed mattress which may be used with or without a waterbed frame.

A further object of the invention is to provide a waterbed mattress which may be used compatibly with conventional waterbed accessories.

BRIEF DESCRIPTION OF THE DRAWINGS

FIG. 1 is a perspective view of the improved waterbed mattress.

FIG. 2 is a top view of the improved waterbed mattress.

FIG. 3 is a side view of the open-celled foam member and appendages.

FIG. 4 is a front view of the open-celled foam member and appendages.

FIG. 5 is a cross-sectional view of the open-celled foam member and appendages.

FIG. 6 is a top view of the open-celled foam member.

FIG. 7 is a perspective view of the improved waterbed mattress.

DESCRIPTION OF THE PREFERRED EMBODIMENTS

Figure 8:
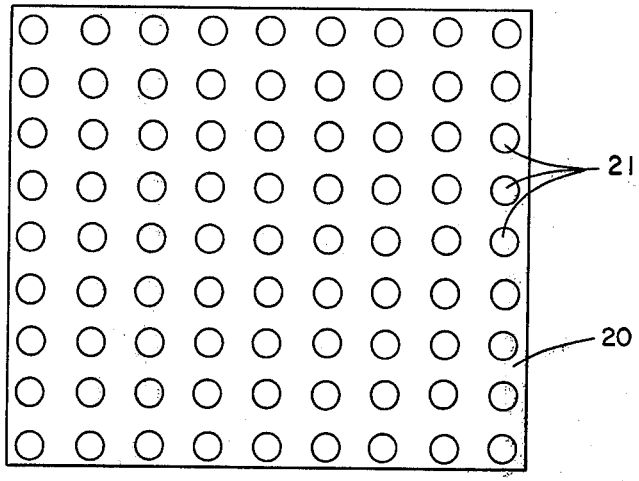
FIG. 8 is a top view of an alternate embodiment of the open-celled foam member.

A wave dampening device 10, which includes a horizontal plate 12 and appendages 13, 14 extending from the lower surface of the plate, is shown in FIG. 1. The dampening device 10 is located inside a water-filled bladder 11, also shown in FIG. 1. The horizontal plate 12 is composed of a flexible open-celled foam, two or three inches in thickness and extending to the lateral peripheral walls of the bladder 11. Although polyurethane is the most commercially available source of the open-celled foam contemplated by the invention, any similar sponge-like material could be used.

As can be seen from FIGS. 1, 2, 3 and 4, one of the appendages protruding from the horizontal plate 12 is a circular wall 13 which extends downward to contact the lower horizontal surface of the bladder 11. The circular wall 13 is centered on the horizontal plate 12. A second set of appendages shown in FIGS. 1, 2, 3 and 4 are semicircular wall sections 14, which also extend downward to contact the lower surface of the bladder 11. The semicircular wall sections 14 are positioned symmetrically about the four corners of the plate 12. The concave surface of each semicircular wall section 14 is directed toward the center of the plate 12. In the preferred embodiment, the appendages are composed of the same open-celled foam as the horizontal plate. However, it would also be possible to attach flexible sheets to the bottom of the plate in place of the foam appendages. FIG. 5 reveals that the circular wall 13 has a downward tapering cross section. The circular wall 13 is of sufficient cross section at the point where it contacts the plate 12 to prevent any tearing or disconnection during use. The tapered cross-sectional shape also affords additional structural stability to the wall, sufficient to overcome the tendency of the lower end of the appendage to bend and "float" in a horizontal position. The cross section of each semicircular wall section 14 is identical to the cross section of the circular wall 13.

The dampening device 10 is extremely flexible and water permeable. In a water permeated condition, the dampening device 10 has a specific gravity slightly less than one. The dampening device 10 therefore, floats with the horizontal plate 12 barely breaking the surface of the water. The buoyancy of the dampening device 10 obviates the need for mechanical attachment to the interior surface of the bladder 11.

The wave dampening properties of the dampening device 10 are attributable to a number of different hydrodynamic effects. The water-filled foam material essentially isolates the water trapped within its cells from the remainder of the water in the bladder 11. A unique property of open-celled foam used in a dampening system is that it uses the water itself to dampen wave action. The foam acts as a flexible form or container and the water entrapped within the foam cells adds a great deal of mass to each of the foam members. The water permeated members tend to vibrate at a different frequency than the main body of water. This nonresonant frequency in the foam members, enhanced by the mass of the water trapped within the foam, tends to cancel the wave action in the main body of water.

A number of other effects also tend to reduce wave action in the improved waterbed. The circular wall 13 isolates the water in the central portion of the water mattress above which a person is most likely to sleep. Transverse waves generated in that area must pass through the circular wall before being transmitted to the outer body of water. The circular wall tends to divide the body of water into nonresonant compartments which have a dampening effect on each other. The rough and porous surface of the foam member can also be expected to dissipate wave energy through friction drag and viscosity induced wake fields. (For general principles of hydrodynamics and kinematics, see *Handbook of Ocean and Underwater Engineering;* Myers, Holm and McAllister; McGraw Hill, 1969.)

The primary effect of wave action in a waterbed is experienced as a periodic surface deformation or "rolling motion." The introduction of a horizontal plate 12 on the surface of the water considerably changes the surface characteristics of the water, impeding the propogation of surface waves. The added mass of the water, when the foam is in a water permeated condition, makes this method of wave reduction more efficient than merely placing a dry foam plate on the exterior upper surface of the waterbed mattress. Because of the wave impeding effect, the upper horizontal plate 12 might also be used without appendages as shown in FIGS. 6 and 7.

Another benefit derived from the dampening device 10 in the preferred embodiment system is that the horizontal plate 12 will cushion the waterbed user against shocks caused by "bottoming out." "Bottoming out" refers to coming into contact with the rigid surface beneath the waterbed mattress which sometimes occurs when a person places too much weight on a small area of the waterbed mattress.

An alternate embodiment of the open-celled foam member 20 is depicted in FIG. 8. In this embodiment, the dampening device has been fabricated from a single sheet of open-celled foam. The foam member 20 is of approximately the same depth as the water in the bladder 11 and extends horizontally to the lateral periphery of the bladder 11. In this embodiment, wave action is nearly eliminated. The greater volume of the water is absorbed by the open-celled foam, thereby disrupting the fluid continuity necessary for the propogation of waves. A plurality of symmetrically spaced vertical holes have been bored through the foam member 20 by conventional means. The foam member 20 is very flexible and deformably and might also be used without the vertical holes. However, the deformation characteristics of an ordinary waterbed can be more closely approximated by adding vertical holes 21 to the foam member 20.

Figure 9:
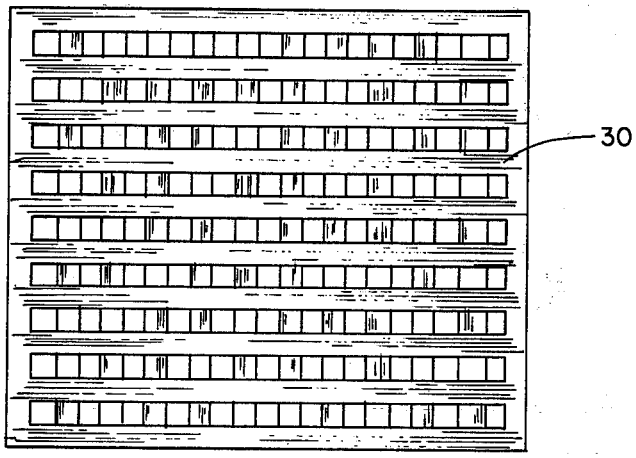
FIG. 9 is a top view of another alternate embodiment of the open-celled foam member.

Another alternative embodiment of a foam dampening device is depicted by the lattice structure 30 shown in FIG. 9. The lattice structure 30 is constructed by gluing or otherwise attaching a number of elongated strips of open-celled foam together in a lattice work. In this particular embodiment, each elongated strip has a rectangular cross section approximately two inches on a side. The bottom layer, if formed by aligning a number of strips of equal length with gaps between the strips approximately equal to the width of each strip. The next layer is formed by aligning strips in the same manner as above, but positioned at right angles to the first layer. Succeeding layers are built up in the same manner. The lattice structure 30 has approximately the same depth as the water in the bladder 11 and extends horizontally to the lateral periphery of the bladder 11. The lattice structure 30, thus contains a network of rectangular open spaces separated by elongated foam strips. In such an arrangement, a large volume of the water is trapped within the open-celled foam and will not readily transmit waves. The remainder of the water located in the open spaces in the lattice work is separated into compartments which further tends to disrupt the transmission of waves.

As shown in FIGS. 1, 2 and 6, an opening 15 is provided at one corner of the upper surface of the bladder 11 for adding or removing water. The surface of the bladder 11 around the opening 15 is adapted in a conventional manner to make the opening recloseable. The design of the opening consists essentially of a flexible neck adapted to accept a screw-on cap. The neck is also capable of being attached to a vacuum device. The vacuum device is used, after the water has been removed from the bladder, to evacuate the air from the bladder and the foam thereby compressing the waterbed mattress into a very small volume for convenient shipping or storage. As shown in FIGS. 1, 2, 6 and 7, a hole 16 in the horizontal plate 12 is located directly below the opening 15 in the bladder 11 to facilitate the addition or removal of water and the evacuation of air from the waterbed mattress. In the alternate embodiment of the foam member 20 shown in FIG. 8, one of the open verticle holes 21 is positioned below the opening 15 in the bladder 11. In the other alternate embodiment of the foam member 30 shown in FIG. 9, the opening 15 in the bladder is positioned above an open portion of the lattice work.

A problem common to most waterbed designs to date has been the removal of air bubbles from the water inside the bladder. The air bubbles create a discontinuity on the surface of the waterbed and also are responsible for a "sloshing" noise when the water is agitated. The foam member 10 absorbs any air bubbles in the water and eliminates these problems.

In summary, the improved waterbed mattress described in the preferred embodiments provide effective means of dampening wave action in a waterbed. The open-celled foam material used as a dampening means also absorbs air bubbles and provides a cushion against the rigid base of the waterbed. (not shown) The foam member and waterbed bladder may be compressed into a very small volume, for convenient shipment and storage by the use of a vacuum connection. The buoyancy of the foam member eliminates the need for attachment to the surface of the bladder 11 saving costly production steps.

Although specific components, proportions and process steps have been stated in the above description of the preferred embodiments of the invention, other suitable materials, proportions and process steps, as listed herein, may be used with satisfactory results in varying degrees of quality. In addition, it will be understood that various other changes of the details, materials, steps, arrangements of parts, and uses which have been herein described and illustrated in order to explain the nature of the invention will occur to and may be made by those skilled in the art, upon a reading of this disclosure, and such changes are intended to be included within the principles and scope of this invention.

I claim:

1. An improved waterbed mattress of a type having a flexible water-filled bladder in which said bladder has a recloseable opening for adding and removing water and air from said bladder wherein the improvement comprises:

(a) at least one bouyant, flexible, foam, horizontal plate member, located inside said bladder and unattached to any surface of said bladder;

(b) appendages depending from the lower surface of said horizontal plate member, wherein said appendages comprise plates having vertically inclined faces extending to a depth of at least half the distance to the bottom wall of said bladder; and (c) attachment means for attaching said appendages to said horizontal plate member.

2. The waterbed mattress as described in claim 1, further comprising a vacuum means for compressing said bladder and said flexible foam member into a small volume by evacuating the air from said bladder and said foam member after said bladder has been drained of water.

3. The waterbed mattress as described in claim 1, wherein said foam member comprises a means for absorbing air bubbles trapped inside said bladder after it has been filled with water.

4. The waterbed mattress as described in claim 1 wherein said appendages comprise open-celled foam appendages.

5. An improved waterbed mattress of a type having a flexible water-filled bladder in which said bladder has a recloseable opening for adding and removing water and air from said bladder wherein the improvement comprises at least one flexible open-celled foam member, located inside said bladder and unattached to any surface of said bladder, for dampening wave action in the water wherein said foam member comprises a bouyant horizontal plate extending to the lateral peripheral wall of said bladder and wherein appendages are attached to said horizontal plate by attachment means and depend from the lower horizontal surface of said horizontal plate; and wherein said appendages comprise a closed wall extending from said horizontal plate toward the lower surface of said bladder and centered with respect to the lateral periphery of said plate and a plurality of wall sections extending from said plate toward the lower surface of said bladder and located symmetrically with respect to the lateral periphery of said plate; and wherein the improvement further comprises a vacuum means for compressing said bladder and said flexible foam member into a small volume by evacuating the air from said bladder and said foam member after said bladder has been drained of water.

6. The waterbed mattress as described in claim 5 wherein said appendages are comprised of flexible open-celled foam of sufficient cross-sectional thickness to maintain a vertical alignment when the water in said bladder is in an agitated condition.

* * * * *